US005564637A

United States Patent [19]

Berthold et al.

[11] Patent Number: 5,564,637

[45] Date of Patent: Oct. 15, 1996

[54] METHOD AND AN APPARATUS FOR WINDING UP ROUND MATERIAL ON A DRUM PROVIDED WITH TERMINAL FLANGES

[75] Inventors: Herbert Berthold, Deutschlandsberg; Hans-Peter Pichler, Graz, both of Austria

[73] Assignee: MAG Maschinen und Apparataebau, Graz, Austria

[21] Appl. No.: 170,115

[22] Filed: Dec. 20, 1993

[30] Foreign Application Priority Data

Dec. 22, 1992 [DE] Germany ..... 42 43 595.1

[51] Int. Cl.[6] ..... B65H 54/00; B65H 63/00; B65H 57/28

[52] U.S. Cl. ..... 242/25 R; 242/36; 242/157.1; 242/158.2; 242/447

[58] Field of Search ..... 242/158.2, 158 R, 242/157.1, 25 R, 7.14, 7.15, 7.16

[56] References Cited

U.S. PATENT DOCUMENTS

| | | | |
|---|---|---|---|
| 2,243,624 | 5/1941 | Gazet | 242/157.1 |
| 2,254,220 | 9/1941 | Hubbard | 242/25 R |
| 2,599,423 | 6/1952 | Ziegler | 242/158 R |
| 3,456,899 | 7/1969 | Smith et al. | 242/158 R |
| 4,150,801 | 4/1979 | Ikegami et al. | 242/158.2 |
| 4,244,539 | 1/1981 | Taneda et al. | 242/158.2 |
| 4,456,199 | 6/1984 | Seibert | 242/158 R X |
| 4,483,496 | 11/1984 | Weinlich | 242/158 R X |
| 4,484,712 | 11/1984 | Leenders | 242/7.15 X |
| 4,570,875 | 2/1986 | Buluschek | 242/25 R X |
| 4,592,521 | 6/1986 | Hallikas et al. | 242/158 R X |
| 4,838,500 | 6/1989 | Graham | 242/158 R |
| 5,364,043 | 11/1994 | Linderoth | 242/158 R X |

FOREIGN PATENT DOCUMENTS

| | | | |
|---|---|---|---|
| 818247 | 9/1937 | France | 242/157.1 |

*Primary Examiner*—Michael R. Mansen
*Attorney, Agent, or Firm*—Dennis T. Griggs

[57] ABSTRACT

A pressure roller in a winding machine is axially shifted in accordance with the progress of winding so that the winding turns are tightly engaged with each other. At the end of a winding layer, the pressure roller is positioned adjacent a flange of the winding drum at a spacing distance equal to 1.5 times the diameter of the round material, so that the next winding layer is wound in the channels between winding turns of the first layer. The pressure roller and the winding drum are axially shiftable independently of each other, thereby providing centering of the drum with respect to the in-feed material and orderly reversal of winding action after each winding layer has been completed. The method and the apparatus are particularly suitable for thick round material which is hard to flex, such as solid or stranded wire or cable.

7 Claims, 3 Drawing Sheets

Z
12
3
6
11
5
8
9
10A
10B 3
5
6
9
10A
10B
11
12
Z

METHOD AND AN APPARATUS FOR WINDING UP ROUND MATERIAL ON A DRUM PROVIDED WITH TERMINAL FLANGES

FIELD OF THE INVENTION

This invention relates to method and apparatus for coordinating the axial movement of a drum and a pressure roller during winding up of round material which is relatively hard to bend, such as thick round wire or cable.

DESCRIPTION OF THE PRIOR ART

When winding up round material such as wire or cable it is important for the material to be so laid that a dense and even coil is produced with an Optimum degree of packing, thus providing kink-free winding and satisfactory unwinding of the round material. This can only be achieved if the round material is wound in turns that are close together and are accurately positioned in the channels between the turns of the underlying layer.

Conventional winding machines use a reciprocating traverse which only guides the supplied round material to follow the course of winding. Such machines fail to provide on changing from one winding layer to the next winding layer that there is no kinking or cocking of the round material and that each turn of the next layer is accurately positioned in the channel between adjacent turns of the underlying winding layer.

SUMMARY OF THE INVENTION

The invention provides reliable and accurate winding up of round material, particularly for wire or cable having a large diameter. A pressure roller engages the round material as it is wound around a drum and is axially shifted in accordance with the progress of winding so that the winding turns are tightly packed against each other. At the end of one winding layer, the pressure roller is positioned adjacent a terminal flange of the winding drum at a spacing distance equal to 1.5 times the diameter of the round material, so that the winding turns in the next layer up are wound in the channels between the winding turns of the underlying layer. The pressure roller and the winding drum are axially shiftable independently of each other, thereby controlling the placement of the supplied round material relative to the drum, and keeping the drum approximately centered with respect to the supplied round material.

The invention will be understood by those skilled in the art upon reading the following detailed description with reference to the accompanying drawings.

DETAILED DESCRIPTION OF A PREFERRED EMBODIMENT

Figure 1:
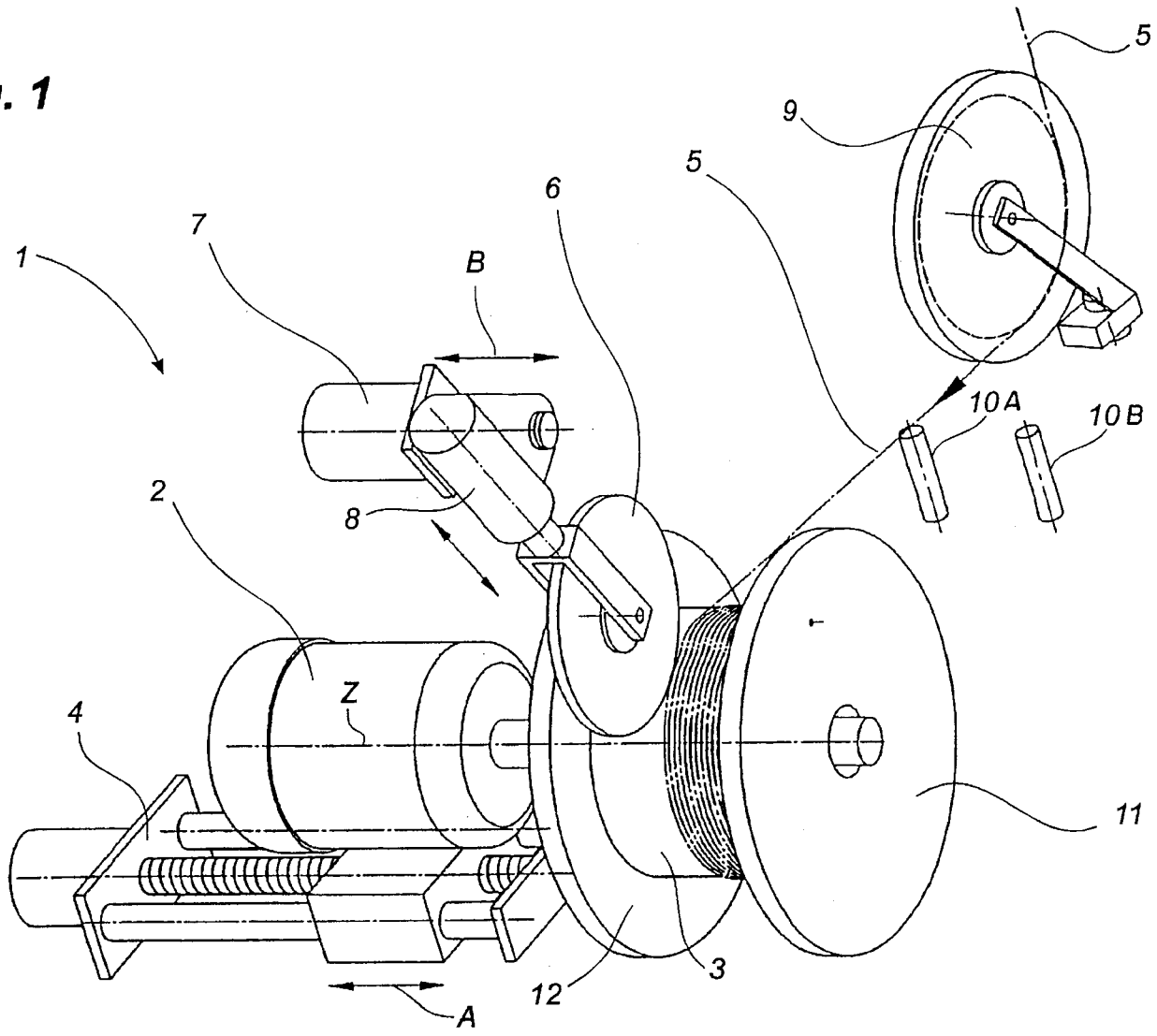
FIG. 1 is a perspective view of the principal components of the preferred embodiment.

Referring now to FIG. 1, the winding apparatus 1 of the present invention includes a winding motor 2 coupled to a winding drum 3. The motor 2 is extended and retracted in opposite directions, as indicated by the arrows A, by a linear screw transmission 4. Adjacent the point of winding contact of round material 5 on the drum 3 there is a pressure roller 6 applying resilient, thrusting pressure against the drum and the round material 5. The means for holding the pressure roller 6 is designed in the form of a linear traverse 7, by means of which the pressure roller 6 is shifted axially in a direction parallel to the rotational axis Z of the drum 3, as indicated by the arrows B.

The roller 6 has the form of a circular disk and has its periphery engaged against the winding drum 3 by a linear actuator 8, which applies a yieldable, resilient thrusting force against the drum. After the initial winding layer is formed, the pressure roller 6 engages the underlying initial winding layer of the round material 5 with one of its surfaces laterally engaging an adjacent turn of wound round material.

The round material 5 to be wound is fed from a supply by way of a stationary pulley wheel 9. Between the pulley wheel 9 and the winding drum 3, two sensors 10A, 10B are positioned on opposite sides of the arriving round material 5 and supply a signal to a computing and control unit in response to lateral movement of the round material 5 proximate the sensing field of one of the sensors 10A, 10B.

The winding operation is represented diagrammatically in FIGS. 2A through 2H in consecutive phases. FIGS. 2A through 2D show the pressure roller 6 and the drum 3 as the supplied round material 5 is wound about the drum. Initially, the axial traversing motion of the round material 5 and the pressure roller 6 relative to the drum is from right to left. FIGS. 2E through 2H illustrate the relative positions of the stationary pulley wheel 9, the round material 5, the sensors 10A, 10B, the winding drum 3 and the pressure roller 6 as the pressure roller 6 traverses from the right flange 11 of the drum toward the left flange 12 of the drum.

Figures 2A, 2B, 2C, 2D, 2E, 2F, 2G, 2H:
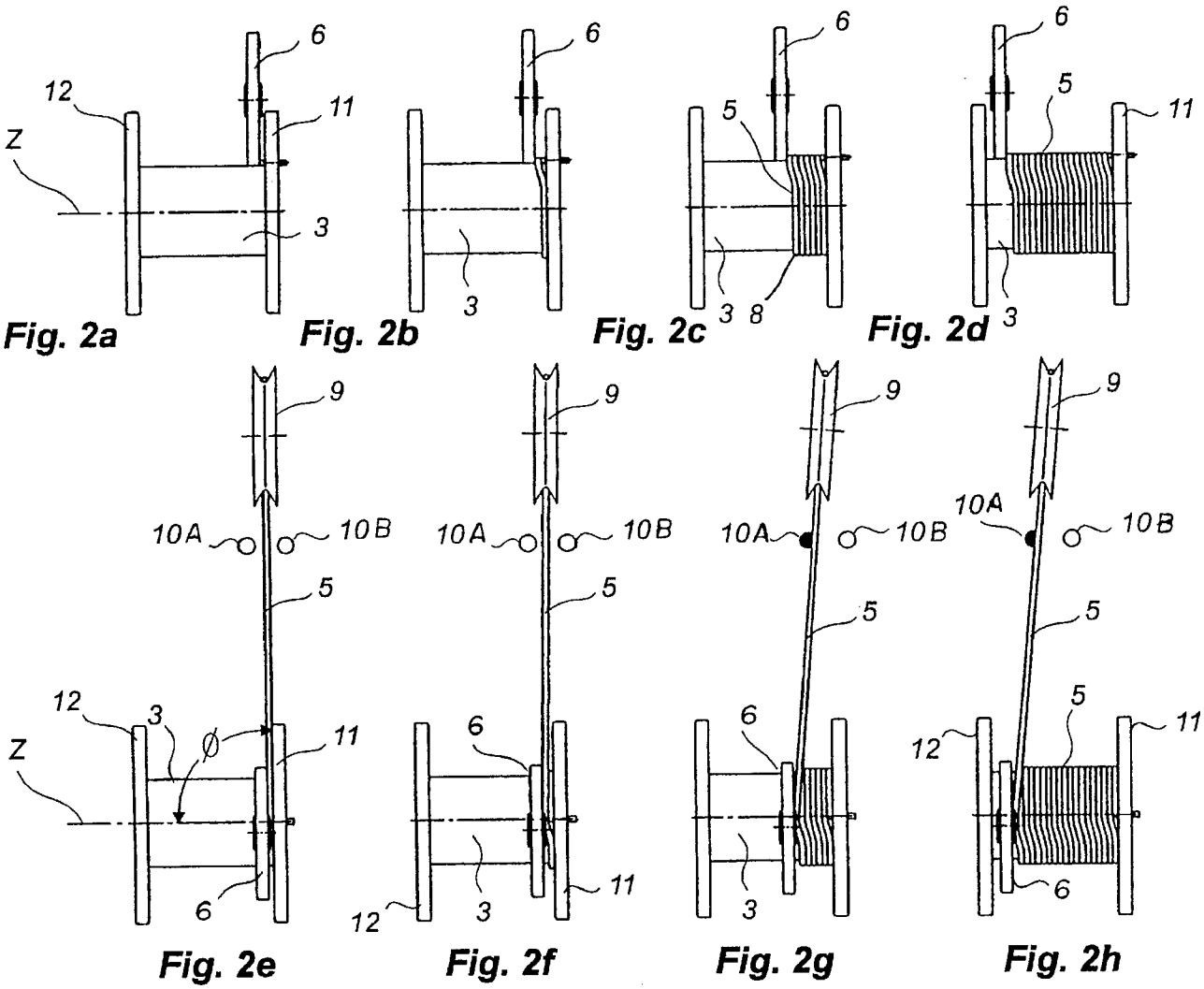
FIGS. 2A, 2B, 2C, and 2D are simplified front elevational views which show the position of a pressure roller as round material is wound on a drum.
FIGS. 2E, 2F, 2G and 2H are top plan views corresponding generally with FIGS. 2A, 2B, 2C and 2D which illustrate angular position and lateral movement of the supplied wound material as it is wound on the winding drum.

At the beginning of a winding operation as shown in FIG. 2A and FIG. 2E, round material 8 coming from the pulley wheel 9 is trained at an in-feed angle $\phi$ of substantially a right angle to the axis Z of the drum 3 without any clearance between it and the surface of the winding drum flange 11. The round material 5 is secured to the drum through a bore drilled in the right flange 11. The pressure roller 6 is initially spaced from the right flange 11 by a distance equal to the diameter of the round material, and it is thrust resiliently against the winding core of the drum by the linear actuator 8. Then the rotary drive motor 2 is switched on and the winding operation is commenced.

At the start of winding the pressure roller 6 is traversed from the right flange 11 toward the left flange 12 while engaging the winding turn already laid through a stroke for each rotation of the drum which corresponds to the diameter of the round material. The winding drum 3 is held axially fixed during this time. However, as an alternative to this, the drum 3 may be shifted axially in a direction opposite to that of axial shifting movement of the pressure roller 6, but with a lower speed than the pressure roller. The speed of shifting movement must in this case be set so that the sum of the axial displacements of the winding drum 3 and of the pressure roller 6 per revolution of the drum is equal to the diameter of the round material.

The axial shift of the pressure roller 6 and/or the winding drum 3 relative to the round material is controlled so that a spacing distance is provided which is substantially equal to the diameter of the round material. According to this arrangement, the turns are wound tightly and are packed in tight lateral engagement with one another and without any lateral intermediate clearance.

Because the winding drum 3 is stationary or is shifted slowly with respect to the supply, the in-feed winding angle $\phi$ (which was initially a right angle) between the rotational axis Z of the drum and the round material 5 coming from the pulley wheel 9 changes. In the sensor limit position shown in FIGS. 2J and 2N, the angle $\phi$ will have attained a value at which the round material 5 triggers the left sensor 10A, which detects the presence of the round material 5. The signal from the left sensor 10A ensures that the axial displacement of the pressure roller 6 is interrupted and the shifting drive 4 of the winding drum is put into operation in a direction opposite to the direction of axial displacement of the pressure roller 6. The speed or displacement is in this case larger than one turn diameter per rotation of the drum. When in the position shown in FIGS. 2B and 2F, the axial displacement of the winding drum 3 is taking place more slowly and the speed is correspondingly increased in the position shown in FIGS. 2C and 2F.

Owing to the more rapid displacement of the winding drum, the change of the in-feed angle $\phi$ is offset and the sensor signal is terminated. Accordingly, the axial displacement of the pressure roller 6 is resumed again and the axial displacement of the winding drum 3 is stopped (or slowed down). This operation is repeated as many times as may be necessary to establish a spacing distance between the pressure roller 6 and the left drum flange 12 of approximately 1.5 times the turn diameter.

As the winding turn nears the left flange 12, as shown in FIGS. 2D and 2H, the direction of axial displacement of the pressure roller is reversed and it is moved in the same direction as the winding drum 3 at a speed corresponding to the diameter thickness of the turn material per rotation of the drum. The consequence of this is that the distance between the pressure roller 6 and the left drum flange 12 is kept constant, however without making any space available for the material supplied to the drum on the left side of the pressure roller 6. Consequently, the supplied round material 5 is pressed beneath the pressure roller 6 and the pressure roller 6 is lifted by the round material so that the second winding layer is laid on top of the first winding layer as shown in 2I, 2M.

Figures 2I, 2J, 2K, 2L, 2M, 2N, 2O, 2P:
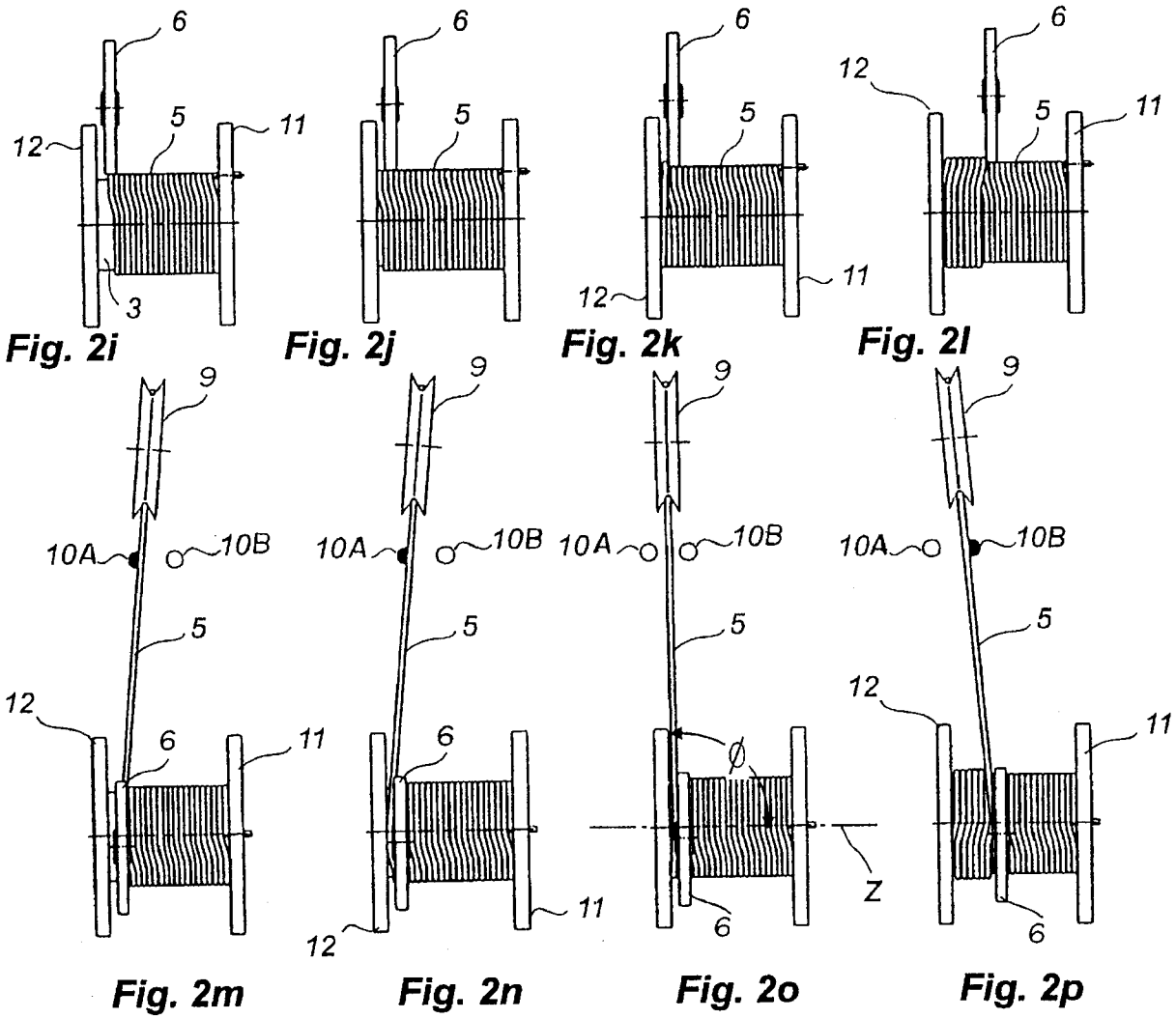
FIGS. 2I, 2J, 2K and 2L are simplified front elevational views which illustrate the position of the pressure roller relative to the underlying winding layer of round material as a subsequent layer of wound material is wound about the first layer.
FIGS. 2M, 2N, 2O and 2P are simplified top plan views corresponding generally with FIGS. 2I, 2J, 2K and 2L which illustrate lateral movement and angular deflection of the round material as it is wound over the initial winding layer.

In the position as shown in FIG. 2J and 2N, the material underneath the pressure roller 6 has reached the opposite drum flange 12. The axial displacement of the winding drum 3 is now increased and maintained until the material coming from the pulley wheel 9 runs at a right angle to the axis Z of the winding drum (FIGS. 2K, O). Then the axial displacement of the winding drum is stopped and the axial displacement of the pressure roller 6 is stopped for one revolution of the winding drum. Accordingly the material is wound over the already existing turns of the first layer and, owing to the spacing of the pressure roller by 1.5 times the diameter of the material from the left flange 12, the initial turn of the second winding layer is laid in the channel between the last and the penultimate turns of the first winding layer.

Referring now to the position shown in FIGS. 2K and O, the traverse 7 for the pressure roller 6 is switched on again and the winding of the second layer is commenced. In the position shown at FIGS. 2L and 2P, the movement of the round material proximate to the sensor limit position of the right sensor 10B triggers the right sensor 10B to generate a control signal which causes a centering movement of the winding drum 3, a reversal of axial movement of the pressure roller 6, and an increase in its axial traverse speed to the left.

Winding is continued in this manner in alternating lateral directions until the drum is filled.

We claim:

1. A method for winding round material on a winding drum between first and second terminal flanges characterized by the following steps:

(a) supplying the round material to the drum;

(b) engaging the pressure roller laterally against the round material;

(c) rotating the winding drum without axial displacement thereof and shifting the pressure roller axially toward one terminal flange by an amount approximately equal to the diameter of the round material per rotation of the winding drum;

(d) interrupting the axial shifting movement of the pressure roller at a predetermined angle between the supplied round material and the rotational axis of the winding drum and displacing the winding drum axially towards the last produced winding turn by an amount exceeding the diameter of the round material per revolution of the winding drum;

(e) repeating steps (c) and (d) until the spacing distance of the pressure roller from said one terminal flange of the winding drum is equal to approximately 1.5 times the diameter of the round material;

(f) axially displacing the winding drum and the pressure roller toward the last produced winding turn by an amount equal to the diameter of the round material;

(g) increasing the axial displacement of the winding drum and of the pressure roller, after the winding has reached said one flange of the drum, until the supplied round material is at substantially a right angle to the axis of the winding drum;

(h) interrupting the axial displacement of the winding drum and of the pressure roller during one rotation of the winding drum, during which time the round material is wound between said one flange of the winding drum and the pressure roller thus producing the last turn of the first winding layer;

(i) winding the round material into the channel between the last and the penultimate turns of the first winding layer; and, (j) repeating the steps (c) through (i) with an opposite direction of axial displacement of the winding drum and pressure roller for winding the next layer.

2. The method as defined in claim 1, characterized in that in step (c) the winding drum is displaced axially in a direction opposite to the pressure roller and at a lower speed relative to the axial displacement speed of the pressure roller, wherein the sum of the displacement strokes of the winding drum and the pressure roller per revolution of the winding drum is substantially equal to the diameter of the round material.

3. Apparatus for taking round material from a supply and winding the round material fed on a winding drum provided with first and second terminal flanges, comprising:

a drive motor coupled to the winding drum for rotating the drum in the direction of winding up;

sensor means disposed at a predetermined limit position between the supply and the drum and proximate the supplied round material for generating a sensor limit signal corresponding to a predetermined angular position of the supplied round material relative to the rotational axis of the drum;

means coupled to the drum for axially shifting the winding drum in response to a sensor limit signal;

a pressure roller disposed in resilient engagement against either the periphery of the winding drum or against an initial winding layer; and a traverse coupled to the pressure roller for guiding the pressure roller against a winding turn of the supplied round material as it is wound on the drum, and for axially shifting the pressure roller independently of the drum.

4. Apparatus as defined in claim 3, characterized in that the pressure roller comprises a circular disk which is journalled for rotation so that its axis of rotation is parallel to the axis of rotation of the winding drum.

5. Apparatus as defined in claim 3, characterized in that the sensor means comprises first and second sensors disposed at laterally opposite positions relative to the supplied round material for detecting movement of the round material proximate first and second lateral limit positions, respectively.

6. Apparatus as defined in claim 3, characterized in that the sensor means comprises first and second optical sensors.

7. Apparatus as defined in claim 3, characterized in that the sensor means comprises first and second electrical proximity sensors.

* * * * *